US009897264B1

(12) United States Patent
Chen

(10) Patent No.: US 9,897,264 B1
(45) Date of Patent: Feb. 20, 2018

(54) NEGATIVE CONNECTING TERMINAL AND NEGATIVE CONNECTOR FOR LED BULB DRIVE BOARD AND LAMP CAP

(71) Applicant: Xiamen GHGM Industrial Trade Co., Ltd., Xiamen (CN)

(72) Inventor: Bingshui Chen, Xiamen (CN)

(73) Assignee: XIAMEN GHGM INDUSTRIAL TRADE CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/611,806

(22) Filed: Jun. 2, 2017

(51) Int. Cl.

| | |
|---|---|
| ***H01R 33/22*** | (2006.01) |
| ***F21K 9/235*** | (2016.01) |
| ***F21V 23/06*** | (2006.01) |
| ***H01R 4/48*** | (2006.01) |

(52) U.S. Cl.
CPC ..... *F21K 9/235* (2016.08); *F21V 23/06* (2013.01); *H01R 4/4809* (2013.01)

(58) Field of Classification Search
CPC ..... H01R 33/22; F21V 23/004
USPC ..... 439/615, 611, 613, 620.02; 313/318.04
See application file for complete search history.

(56) References Cited

U.S. PATENT DOCUMENTS 4,820,956 A * 4/1989 Slobodzian ..... G09F 13/28 313/318.01
5,627,433 A * 5/1997 Fulop ..... H01J 5/62 313/318.04
5,629,581 A * 5/1997 Belle ..... H01J 5/62 313/318.12
6,488,538 B1 * 12/2002 Matsuba ..... H01J 5/54 439/615
7,892,031 B1 * 2/2011 Mostoller ..... H01J 5/50 313/317
8,222,820 B2 * 7/2012 Wang ..... F21V 17/14 313/46
8,858,027 B2 * 10/2014 Takeuchi ..... F21V 23/001 362/249.02
8,963,410 B2 * 2/2015 Wu ..... F21K 9/13 313/318.01
9,033,742 B2 * 5/2015 Urano ..... H01R 12/721 313/318.04
9,151,480 B2 * 10/2015 Mostoller ..... F21K 9/00
9,310,061 B2 * 4/2016 Mostoller ..... F21K 9/00
9,634,414 B1 * 4/2017 Chen ..... H01R 13/113
9,673,544 B1 * 6/2017 Chen ..... H01R 12/718
9,702,530 B2 * 7/2017 Gielen ..... F21V 17/10
9,709,256 B2 * 7/2017 Chen ..... F21V 23/06
9,829,187 B2 * 11/2017 Fedele ..... F21V 23/06
(Continued)

*Primary Examiner* — Neil Abrams
(74) *Attorney, Agent, or Firm* — Leong C. Lei

(57) ABSTRACT

A negative connecting terminal for an LED bulb drive board and a lamp cap is provided. A side of a base plate is formed with an elastic sheet to be electrically connected with a lamp cap negative pole. The elastic sheet is bent from the side of the base plate to form a small curved portion having an opening facing rearward and then bent again to form a big curved portion having an opening facing forward, and obliquely extends forward to form an oblique extension portion, and finally is bent to form a head portion. The side of the base plate extends outward to form an insertion pin to be electrically connected with a drive board. The negative connecting terminal is simple in structure and more flexible and has a greater working stroke and can be processed more easily.

7 Claims, 5 Drawing Sheets

(56) References Cited

U.S. PATENT DOCUMENTS

| | | | | |
|---|---|---|---|---|
| 2009/0295268 | A1* | 12/2009 | Peng | H01J 5/62<br>313/318.04 |
| 2016/0380400 | A1* | 12/2016 | Chen | H01R 33/22<br>439/620.02 |
| 2017/0012379 | A1* | 1/2017 | Chen | H01R 13/11 |

* cited by examiner

NEGATIVE CONNECTING TERMINAL AND NEGATIVE CONNECTOR FOR LED BULB DRIVE BOARD AND LAMP CAP

BACKGROUND OF THE INVENTION

1. Field of the Invention

The present invention relates to a power supply connection technique for an LED bulb, and more particularly, to a negative connecting terminal for an LED bulb drive board and a lamp cap and a negative connector.

2. Description of the Prior Art

In the prior art, the drive board of an LED bulb is connected with the positive and negative poles of a lamp cap by means of a wire connection. One end of the wire is welded to the drive board, and the other end of the wire is welded to the lamp cap, or the wire is hung on a lamp holder and then the lamp cap is locked to achieve the connection. Such a wire connection has a complex manufacturing, and its assembly efficiency is low, and the defeat rate is also high.

An electrical connecting terminal (including a positive connecting terminal 100' and a negative connecting terminal 200') for an LED bulb drive board and a lamp cap is developed by the inventor of this application. As shown in FIG. 1 to FIG. 4, the electrical connecting terminal comprises a base plate 10', an elastic sheet 20', and an insertion pin 30 or a weld pin. The side of the base plate 10' obliquely extends upward and forward and is bent to form the elastic sheet 20' to be electrically connected with the poles (including a lamp cap positive pole 601' and a lamp cap negative pole 602') of a lamp cap 600'. The side of the base plate 10' extends outward or is bent to form the insertion pin 30' or the weld pin to be electrically connected with a drive board 700'. For a negative connector, the negative connecting terminal 200' is mounted to a negative plastic core or mounted to an integrated plastic core 500' (having the functions of a positive plastic core and a negative plastic core for installation of the positive connecting terminal 100' and the negative connecting terminal 200'). The negative plastic core or the integrated plastic core 500' is fixed to the drive board 700', and is formed with a slot 504'. The outer wall of the slot 504' is formed with a slope 505' and a step 506'.

The base plate 10' of the negative connecting terminal 200' is securely inserted in the slot 504' toward the LED bulb from the lamp cap. The insertion pin 30' or the weld pin is exposed out of the negative plastic core or the integrated plastic core 500' to be electrically connected with the drive board 700'. The elastic sheet 20' extends out of the slot 504' toward the inside of the LED bulb. A root portion 22' and an inclined extension portion 21' of the elastic sheet 20' lean against the slope 505' at the outer wall of the slot 504'. The slope 505' provides a support for the elastic sheet 20', thereby preventing the elastic sheet 20' from being deformed to ensure electrical connection. The elastic sheet 20' is elastically in contact with the lamp cap negative pole 602' to achieve electrical connection. The head portion 23' of the elastic sheet 20' is hooked on the step 506' at the outer wall of the slot 504'.

The positive connecting terminal 100' and the negative connecting terminal 200' of the above-described structure can be mounted on the drive board 700' in advance by means of a corresponding plastic core (e.g., the integrated plastic core 500') and then disposed in a lamp holder 800 along with the installation of the drive board 700'. When the lamp cap 600' is installed, the lamp cap positive pole 601' is inserted into a plastic core hole 502' to be elastically in contact with the elastic sheet 20' of the positive connecting terminal 100' to achieve a positive electrical connection. The elastic sheet 20' of the negative connecting terminal 200' is compressed to get contact with the lamp cap negative pole 602' to achieve a negative electrical connection. The connection process is simple, and the assembly efficiency is high, and the connection is stable, and the product yield is greatly improved.

However, the inventor further studies and finds that the negative connecting terminal needs improving. The elastic sheet 20' of the negative connecting terminal 200' directly obliquely extends upward and forward from the side of the base plate 10' and is bent at the head portion 23'. The joint of the root portion 22' of the elastic sheet 20' and the base plate 10' is hardly elastic. The inclined extension portion 21' and the root portion 22' lean against the slope 505' at the outer wall of the slot 504' when assembled. The elasticity mainly concentrates on the curved head portion 23' of the elastic sheet 20'. The working stroke of the elastic sheet 20' is smaller. (As shown in FIG. 4, the working stroke from the elastic sheet 20' in broken lines to the elastic sheet 20' in solid lines is short.) The elasticity of the elastic sheet 20' is small. The elastic sheet 20' is bent at the head portion 23 away from the base plate 10', and there is no stress support during processing. The bending work is not easy. Accordingly, the present invention intends to provide a dual faucet structure for improving the shortcomings mentioned above.

SUMMARY OF THE INVENTION

The primary object of the present invention is to provide a negative connecting terminal for an LED bulb drive board and a lamp cap. The negative connecting terminal is simple in structure and more flexible and has a greater working stroke and can be processed more easily.

According to one aspect of the present invention, a negative connecting terminal for an LED bulb drive board and a lamp cap is provided. The negative connecting terminal comprises a base plate, an elastic sheet, and a drive terminal. A side of the base plate is formed with the elastic sheet to be electrically connected with a lamp cap negative pole. The elastic sheet is bent from the side of the base plate to form a small curved portion having an opening facing rearward and then bent again to form a big curved portion having an opening facing forward, and obliquely extends forward to form an oblique extension portion, and finally is bent to form a head portion. The side of the base plate extends outward to form the drive terminal to be electrically connected with a drive board. The drive terminal is an insertion pin extending outward from the side of the base plate, alternatively, the drive terminal is a weld pin bent outward from the side of the base plate.

Preferably, the base plate is in the form of a frame (such as a ⊏ shape or in a □ shape).

Preferably, the small curved portion and the large curved portion of the elastic sheet each have an arc shape. The small curved portion, the large curved portion, and the oblique extension portion each have a middle reinforcing rib.

According to another aspect of the present invention, a negative connector for an LED bulb drive board and a lamp cap is provided. The negative connector comprises a plastic core and the aforesaid negative connecting terminal. The plastic core is fixed to the drive board. The plastic core is formed with a slot. An outer wall of the slot is formed with a recess. The base plate of the negative connecting terminal is securely inserted into the slot. The insertion pin or the weld pin is exposed out of the plastic core to be electrically connected with the drive board. The elastic sheet extends out of the slot. The small curved portion is located in the recess. The head portion of the elastic sheet is elastically in contact with the lamp cap negative pole for electrical connection.

Preferably, the outer wall of the slot is formed with a slope.

The present invention has a simple structure. The small curved portion and the large curved portion are provided between the root portion of the elastic sheet and the base plate to increase the elasticity of the root portion of the elastic sheet, so that the elasticity of the whole elastic sheet is also increased. When the elastic sheet is mounted to the plastic core, the slot of the plastic core protects the small curved portion, and the big curved portion cooperates with the small curved portion, enabling the working stroke of the elastic sheet to become larger. The main bending of the elastic sheet is at the root portion. The root portion is close to the base plate. The base plate provides a native bending stress support, so that the bending process is easier.

DETAILED DESCRIPTION OF THE PREFERRED EMBODIMENTS

Figure 1:
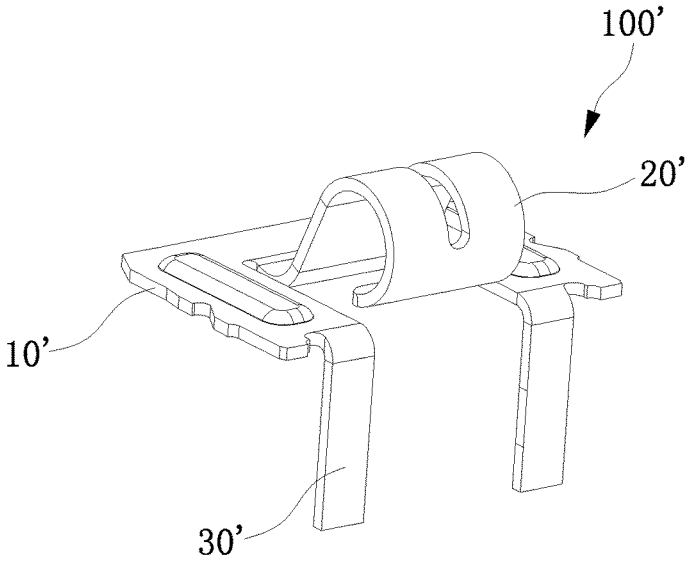
F I G. 1 Prior art
FIG. 1 is a perspective view of a conventional positive connecting terminal.
Figure 2:
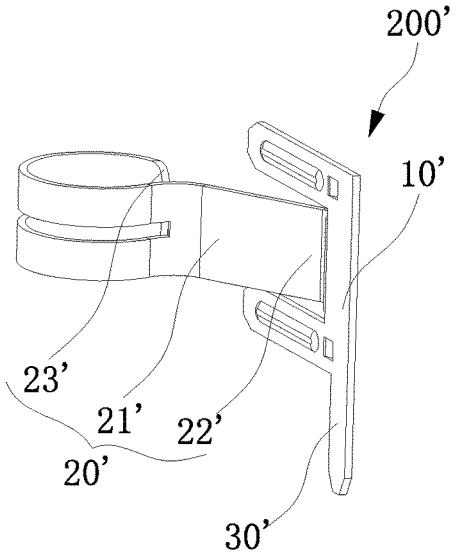
F I G. 2 Prior art
FIG. 2 is a perspective view of a conventional negative connecting terminal.
Figure 3:
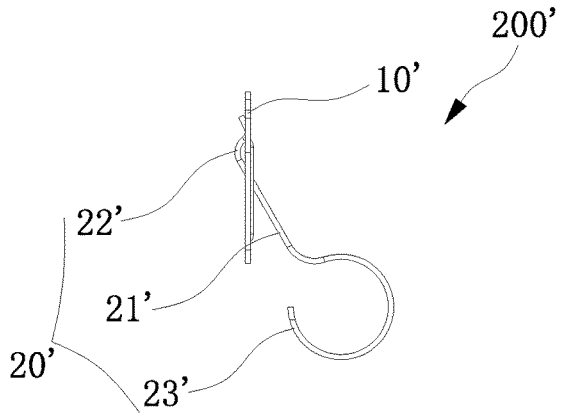
F I G. 3 Prior art
FIG. 3 is a side view of the conventional negative connecting terminal.

Embodiments of the present invention will now be described, by way of example only, with reference to the accompanying drawings.

As shown in FIG. 5 to FIG. 9, the present invention discloses a negative connecting terminal 200 for an LED bulb drive board and a lamp cap. The negative connecting terminal 200 comprises a base plate 10, an elastic sheet 20, and an insertion pin 30 or a weld pin.

The base plate 10 may be a single plate or in the form of a frame (generally in a ⊏ shape or in a □ shape). In order to increase the firmness of installation, the base plate 10 is formed with a raised rib 11.

One side of the base plate 10 is formed with the elastic sheet 20. The elastic sheet 20 is adapted to be electrically connected with a lamp cap negative pole 602. The elastic sheet 20 is first bent from the side of the base plate 10 to form a small curved portion 21 having an opening facing rearward and then bent again to form a big curved portion 21 having an opening facing forward, and obliquely extends forward to form an oblique extension portion 23, and finally is bent to form a head portion 24. In order to make the stress more uniform and to make the elasticity better, the small curved portion 21 and the large curved portion 22 of the elastic sheet 20 are each designed in an arc shape. The small curved portion 21, the large curved portion 22, and the oblique extension portion 23 are provided with a middle reinforcing rib 25.

The side of the base plate 10 extends outward or is bent to form the insertion pin 30 or the weld pin. The insertion pin 30 is adapted for electrical connection with a drive board 700. The weld pin is welded to the drive board 700 to achieve electrical connection.

When the negative connecting terminal 200 is electrically connected with the drive board 700 and the lamp cap 600, the negative connecting terminal 100 and a positive connecting terminal 100 may be mounted by means of respective plastic cores or by means of a common plastic core. The present invention further discloses a negative connector 400. The negative connector 400 comprises a plastic core 300 and the aforesaid negative connecting terminal 200. The plastic core 300 is fixed to the drive board 700. The plastic core 300 is formed with a slot 301. An outer wall of the slot 301 is formed with a recess 302.

The base plate 10 of the negative connecting terminal 200 is securely inserted into the slot 301 in the direction of the LED bulb from the lamp cap 600. The insertion pin 30 or the weld pin is exposed out of the plastic core 300 for electrical connection with the drive board 700. The elastic sheet 20 extends out of the slot 301. The small curved portion 21 is located in the recess 302. The slot 301 functions to protect the small curved portion 21. The head portion 24 of the elastic sheet 20 is elastically in contact with the lamp cap negative pole 602 for electrical connection. The outer wall of the slot 301 is further formed with a slope 303. When the elastic sheet 20 is deformed at the maximum, the oblique extension portion 23 will lean against the slope 303 to provide a support for the elastic sheet 20, thereby preventing the elastic sheet 20 from being deformed to ensure electrical connection.

Figure 4:
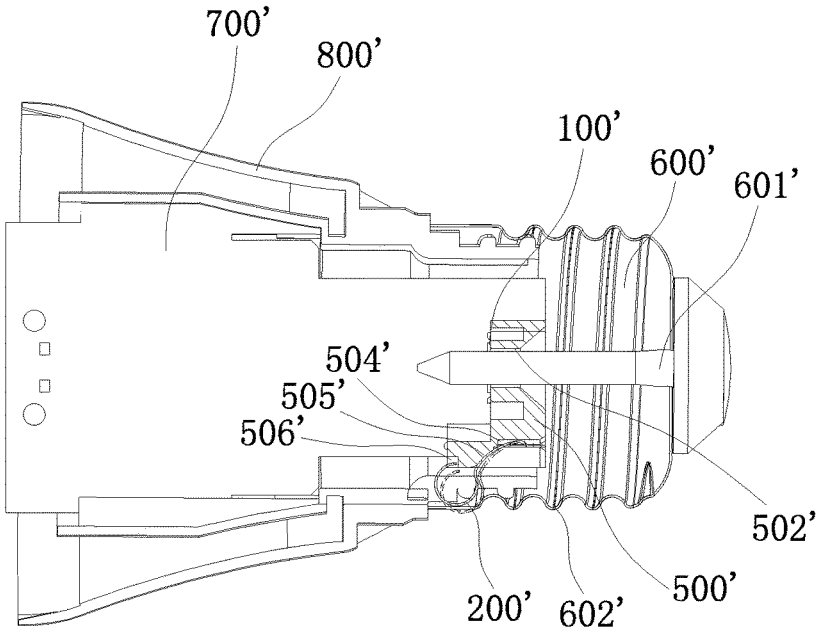
F I G. 4 Prior art
FIG. 4 is a sectional view of the conventional positive and negative connecting terminals mounted to an LED bulb by means of an integrated plastic core.
Figure 5:
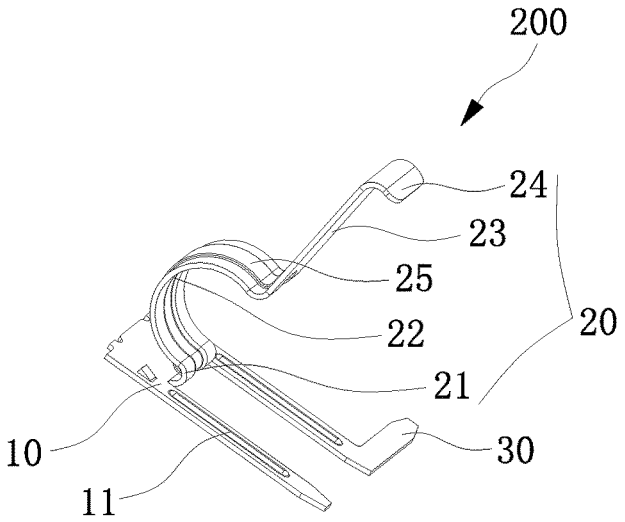
FIG. 5 is a perspective view of the negative connecting terminal of the present invention.
Figure 6:
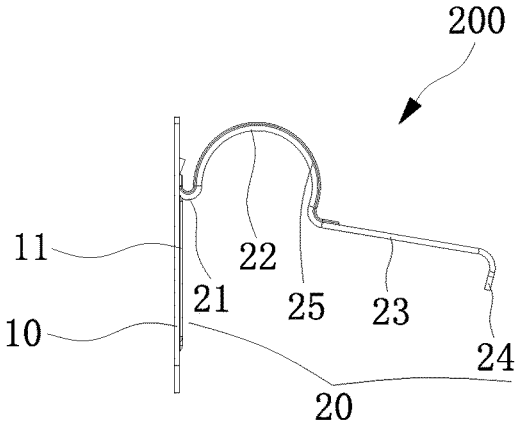
FIG. 6 is a side view of the negative connecting terminal of the present invention.
Figure 7:
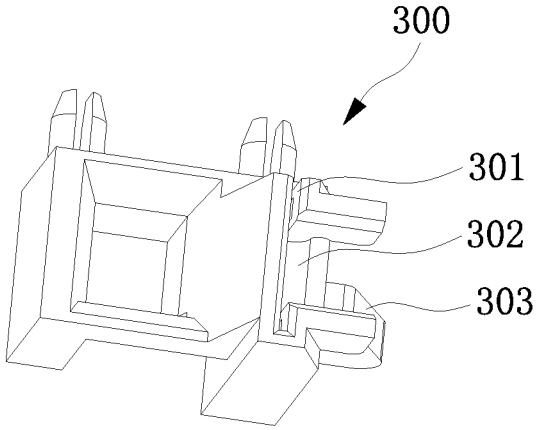
FIG. 7 is a perspective view of the plastic core of the present invention.
Figure 8:
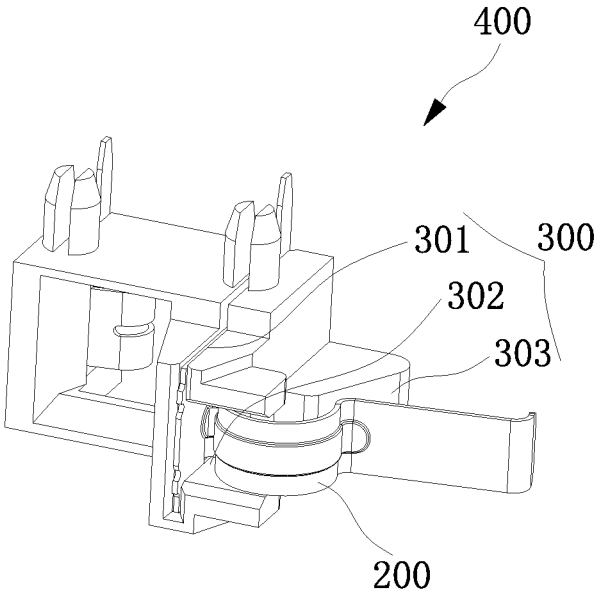
FIG. 8 is a perspective view of the negative connector of the present invention.
Figure 9:
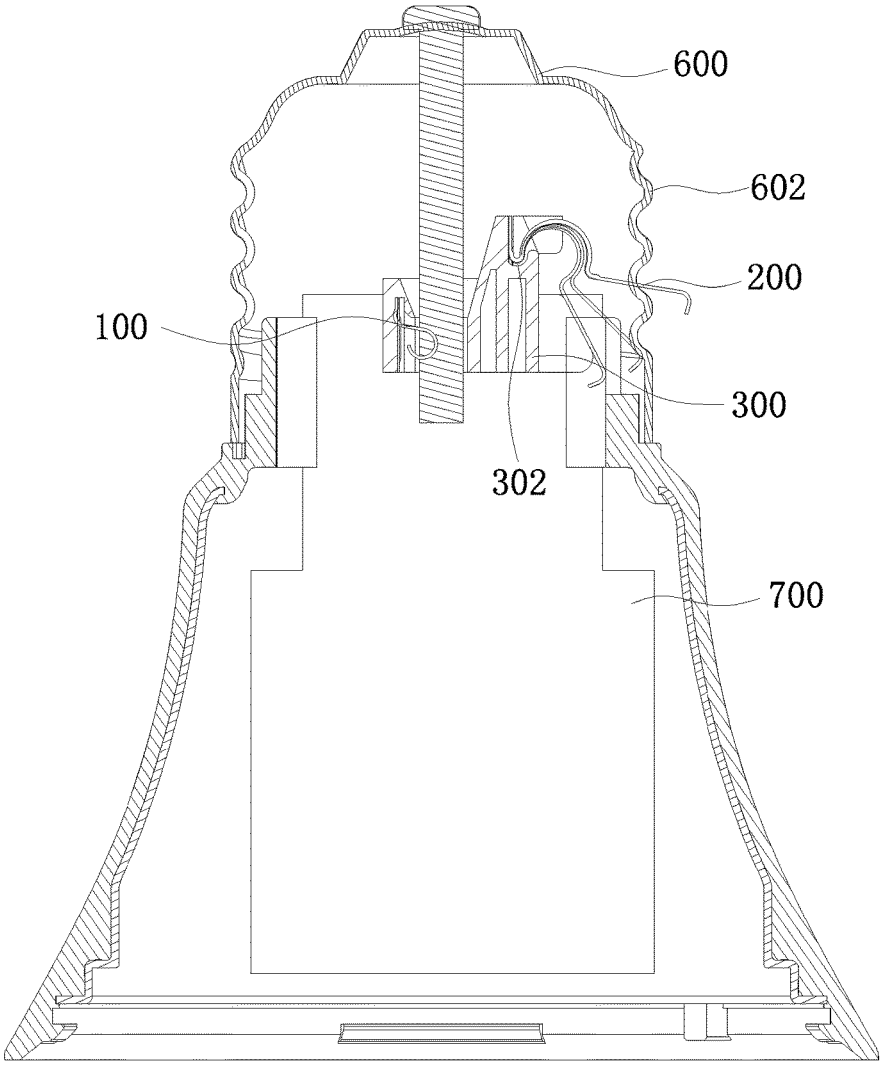
FIG. 9 is a sectional view of the present invention applied to an LED bulb.

The present invention has a simple structure. The elasticity of the root portion of the elastic sheet 20 is increased through the small curved portion 21 and the large curved portion 22, so that the elasticity of the whole elastic sheet 20 is also increased. When the elastic sheet 20 is mounted to the plastic core 300, the working stroke of the elastic sheet 20 becomes larger. As shown by the dotted lines in FIG. 9, the working stroke of the elastic sheet 20 of the present invention is significantly larger than the working stroke of the elastic sheet 20' as shown in FIG. 4. The main bending of the elastic sheet 20 is at the root portion (formed with the small curved portion 21 and the large curved portion 22). The root portion is close to the base plate 10. The base plate 10 provides a native bending stress support, so that the bending process is easier.

The structure and installation of the positive connecting terminal 100 may be the same as those of the prior art, or may be other modifications. Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A negative connecting terminal for an LED bulb drive board and a lamp cap, comprising a base plate, an elastic sheet, and a drive terminal; a side of the base plate being formed with the elastic sheet to be electrically connected with a lamp cap negative pole, the elastic sheet being bent from the side of the base plate to form a small curved portion having an opening facing rearward and then bent again to form a big curved portion having an opening facing forward, and obliquely extending forward to form an oblique extension portion, and finally being bent to form a head portion; the side of the base plate extending outward to form the drive terminal to be electrically connected with a drive board.

2. The negative connecting terminal for an LED bulb drive board and a lamp cap as claimed in claim 1, wherein the drive terminal is an insertion pin extending outward from the side of the base plate.

3. The negative connecting terminal for an LED bulb drive board and a lamp cap as claimed in claim 1, wherein the drive terminal is a weld pin bent outward from the side of the base plate.

4. The negative connecting terminal for an LED bulb drive board and a lamp cap as claimed in claim 1, wherein the base plate is in the form of a frame.

5. The negative connecting terminal for an LED bulb drive board and a lamp cap as claimed in claim 1, wherein the small curved portion and the large curved portion of the elastic sheet each have an arc shape, and the small curved portion, the large curved portion, and the oblique extension portion each have a middle reinforcing rib.

6. A negative connector for an LED bulb drive board and a lamp cap, comprising a plastic core and the negative connecting terminal as claimed in claim 1; the plastic core being fixed to the drive board, the plastic core being formed with a slot, an outer wall of the slot being formed with a recess; the base plate of the negative connecting terminal being securely inserted into the slot, the drive terminal being exposed out of the plastic core to be electrically connected with the drive board, the elastic sheet extending out of the slot, the small curved portion being located in the recess, the head portion of the elastic sheet being elastically in contact with the lamp cap negative pole for electrical connection.

7. The negative connector for an LED bulb drive board and a lamp cap as claimed in claim 6, wherein the outer wall of the slot is formed with a slope.

* * * * *